US011391546B2

(12) United States Patent
Banducci et al.

(10) Patent No.: US 11,391,546 B2
(45) Date of Patent: Jul. 19, 2022

(54) BALLISTIC HELMET WITH AN ACCESSORY SYSTEM

(71) Applicant: United Shield International LLC, Traverse City, MI (US)

(72) Inventors: Paul Banducci, Traverse City, MI (US); Tom Steffen, Pompano Beach, FL (US); Matthew Asher, Aventura, FL (US)

(73) Assignee: United Shield International LLC, Traverse City, MI (US)

( * ) Notice: Subject to any disclaimer, the term of this patent is extended or adjusted under 35 U.S.C. 154(b) by 261 days.

(21) Appl. No.: 16/595,048

(22) Filed: Oct. 7, 2019

(65) Prior Publication Data

US 2020/0109920 A1 Apr. 9, 2020

Related U.S. Application Data

(60) Provisional application No. 62/747,988, filed on Oct. 19, 2018, provisional application No. 62/742,783, filed on Oct. 8, 2018, provisional application No. 62/742,789, filed on Oct. 8, 2018.

(51) Int. Cl.

| | |
|---|---|
| ***F41H 1/04*** | (2006.01) |
| ***A42B 3/14*** | (2006.01) |
| ***A42B 3/08*** | (2006.01) |

(52) U.S. Cl.

CPC ..... *F41H 1/04* (2013.01); *A42B 3/142* (2013.01); *A42B 3/08* (2013.01); *A42B 3/145* (2013.01)

(58) Field of Classification Search

CPC .. F41H 1/04; A42B 3/08; A42B 3/085; A42B 3/142; A42B 3/145

See application file for complete search history.

(56) References Cited

U.S. PATENT DOCUMENTS

| | | | | |
|---|---|---|---|---|
| 2,649,019 | A | 8/1953 | Hartline et al. | |
| 4,703,879 | A | 11/1987 | Kastendieck et al. | |
| 5,983,405 | A * | 11/1999 | Casale | A42B 3/145 2/417 |
| 7,770,239 | B1 | 8/2010 | Goldman et al. | |
| 9,066,551 | B2 * | 6/2015 | Van Waes | A42B 3/08 |
| 9,204,678 | B1 * | 12/2015 | Brachos | A42B 3/147 |
| 9,743,701 | B2 * | 8/2017 | Javorek | A42B 3/08 |
| 10,588,374 | B2 * | 3/2020 | Maloney | A42B 3/142 |
| 2005/0210567 | A1 | 9/2005 | Rogers et al. | |
| 2013/0239303 | A1 | 9/2013 | Cotterman et al. | |
| 2014/0096310 | A1 * | 4/2014 | Szalkowski | A42B 3/085 2/411 |
| 2015/0305429 | A1 * | 10/2015 | Javorek | A42B 3/08 2/421 |
| 2017/0273390 | A1 * | 9/2017 | Maloney | A42B 3/145 |

FOREIGN PATENT DOCUMENTS

JP 2006188771 A 7/2006

* cited by examiner

*Primary Examiner* — Katherine M Moran
(74) *Attorney, Agent, or Firm* — Honigman LLP

(57) ABSTRACT

The disclosure provides a ballistic helmet that includes a helmet shell and a harness connected to the helmet shell. The helmet shell includes a front portion and a rear portion. The harness includes a nape pad, a tensioner disposed on the nape pad, more than one securement strap, and a tension cable. The more than one securement strap is connected to the nape pad and is configured to fasten to the rear portion of the helmet shell. The tension cable is selectively adjustable by the tensioner and is configured to fasten to the front portion of the helmet shell.

20 Claims, 8 Drawing Sheets

BALLISTIC HELMET WITH AN ACCESSORY SYSTEM

CROSS REFERENCE TO RELATED APPLICATIONS

This U.S. patent application claims priority under 35 U.S.C. § 119(e) to U.S. Provisional Application 62/747,988, filed on Oct. 19, 2018, U.S. Provisional Application 62/742,783, filed on Oct. 8, 2018, and U.S. Provisional Application 62/742,789, filed on Oct. 8, 2018. The disclosures of these prior applications are considered part of the disclosure of this application and are hereby incorporated by reference in their entireties.

TECHNICAL FIELD

This disclosure relates to ballistic helmets with an accessory system.

BACKGROUND

A ballistic helmet is a piece of headgear configured to be worn by a wearer (e.g., military personnel or a law enforcement officer) for protection. As a protective covering, the ballistic helmet may prevent or reduce potential damage from projectiles (e.g., bullets or shrapnel) to a head region of the user. For example, the helmet covers head of the wearer such that the helmet shields the brain of the wearer from exposure. By shielding the head of a wear, the helmet protects the brain from potential danger or injury. In addition to providing protection, the ballistic helmet may provide other functions by mounting systems attached to the helmet. These additional mounting systems may allow the wearer to mount tactical accessories (e.g., lights, glasses, masks, sights, communication equipment, etc.). With mounted tactical accessories, the wearer may be free to use his or her hands, for example, while wearing the helmet.

SUMMARY

One aspect of the disclosure provides a ballistic helmet. The ballistic helmet includes a helmet shell and a harness connected to the helmet shell. The helmet shell includes a front portion and a rear portion. The harness includes a nape pad, a tensioner disposed on the nape pad, more than one securement strap, and a tension cable. The more than one securement strap is connected to the nape pad and is configured to fasten to the rear portion of the helmet shell. The tension cable is selectively adjustable by the tensioner and is configured to fasten to the front portion of the helmet shell.

Another aspect of the disclosure provides a harness for a ballistic helmet. The harness includes a nape pad, a tensioner disposed on the nape pad, more than one securement strap, and a tension cable. The more than one securement strap is connected to the nape pad and is configured to fasten to the rear portion of the helmet shell. The tension cable is selectively adjustable by the tensioner and is configured to fasten to the front portion of the helmet shell.

Implementations of either disclosure (e.g., the ballistic helmet or the harness) may include one or more of the following optional features. In some implementations, the tension cable is configured to fasten to the front portion of the helmet shell at a position on the helmet shell adjacent to a temple of a helmet wearer. In some configurations, the front portion of the helmet shell corresponds to a frontal bone of a helmet wearer and the rear portion of the helmet shell corresponds to a parietal bone of the helmet wearer. In some examples, the tension cable includes a first end and a second end where the first end and the second end are configured to fasten to opposite sides of the front portion of the helmet shell. The tension cable may be a unitary structure extending from a first side of the front portion of the helmet shell to an opposite second side of the front portion of the helmet shell.

In some examples, the cable securement strap is connected to the first end and configured to fasten to the front portion of the helmet shell. Here, the cable securement strap includes an aperture configured to receive a fastener to fasten to the front portion of the helmet shell. In some implementations, a sleeve protects an outer surface of the tension cable. In some configurations, the more than one securement strap includes an eyelet for receiving the tension cable. Here, the eyelet may receive the tension cable when the tension cable is fastened to the front portion of the helmet shell. In some examples, the nape pad includes guides that direct the tension cable towards the front portion of the helmet shell. In some implementations, the more than one securement strap is directly fixed to the nape pad and the tension cable is free of direct connections to the nape pad.

In some configurations, the more than one securement strap includes a first upper strap, a second upper strap, a first lower strap, and a second lower strap. In these configurations, the first upper strap is connected to the nape pad and configured to fasten to the rear portion of the helmet shell. Here, the second upper strap is connected to the nape pad opposite to the first upper strap and configured to fasten to the rear portion of the helmet shell on a side of the rear portion of the helmet shell opposite the first upper strap. In these configurations, the first lower strap is connected to the nape pad and forms a first adjustable portion of a chin strap and the second lower strap is connected to the nape pad opposite the first lower strap and forms a second adjustable portion of the chin strap. In some examples, the chin strap includes four adjustable portions and is configured to attach to each side of the front portion of the helmet shell. Here, the chin strap is configured to be commonly affixed with the first upper strap and the second upper strap at each side of the front portion of the helmet shell.

In some examples, the first upper strap and the first lower strap include a continuous strap extending through an internal cavity of the nape pad. In these examples, the second upper strap and the second lower strap include a second continuous strap extending through the internal cavity of the nape pad.

Yet another aspect of the disclosure provides a method of assembling a ballistic harness. The method includes providing a helmet shell including a front portion and a rear portion. The method further includes attaching a harness to the helmet shell. Here, the harness includes a nape pad, a tensioner disposed on the nape pad, more than one securement strap, and a tension cable. The more than one securement strap is connected to the nape pad and is configured to fasten to the rear portion of the helmet shell. The tension cable is selectively adjustable by the tensioner and is configured to fasten to the front portion of the helmet shell.

This aspect may include one or more of the following optional features. In some examples, attaching the harness to the helmet shell includes fastening a first end and a second end of the tension cable to opposite sides of the front portion of the helmet at a position on the helmet adjacent a temple of the wearer. The tension cable may be a unitary structure extending from a front portion of the helmet to an opposite second side of the front portion of the helmet. In some implementations, attaching the harness to the helmet shell includes connecting a cable securement strap to a first end of the tension cable and to the front portion of the helmet. In some configurations, attaching the harness to the helmet shell includes fastening an end of the tension cable to the front portion of the helmet through an eyelet of the more than one securement strap. The more than one securement strap may be directly fixed to the nape pad and the tension cable is free of direct connections to the nape pad.

In some examples, attaching the harness to the helmet shell includes the following: fastening a first upper strap of the more than one securement strap to the rear portion of the helmet where the first upper strap of the more than one securement strap is connected to the nape pad; and fastening a second upper strap of the more than one securement strap to the rear portion of the helmet opposite the first upper strap where the second upper strap of the more than one securement strap is connected to the nape pad opposite the first upper strap. In these examples, attaching the harness to the helmet shell may further include fastening a chin strap to each side of the helmet shell at a front portion of the helmet shell where the more than one securement strap connected to the nap pad includes a first lower strap and a second lower strap opposite the first lower strap. Here, each of the first lower strap and the second lower strap is connected to an adjustable portion of the chin strap. In these examples, fastening the chin strap to each side of the helmet shell at the front portion of the helmet shell may include commonly affixing at least a first portion of the chin strap with the first upper strap.

In another aspect of the disclosure, the ballistic helmet includes a helmet shell, a mounting system, and a harness. The helmet shell includes an outer surface and an internal surface. The mounting surface is attached to an outer surface of the helmet shell at a first attachment location. The harness includes an internal surface of the helmet shell at a second attachment location where the second attachment location is different from the first attachment location.

Implementations of this disclosure may include one or more of the following optional features. In some examples, the mounting system includes a mounting housing fixed to the outer surface of the helmet shell and a rail insert disposed on the mounting housing. In some implementations, the rail insert corresponds to a Picatinny rail. In some configurations, the mounting housing is an arcuate shape located at an edge of the helmet shell. The mounting housing may include a plurality of openings configured to receive the rail insert. Here, the rail insert affixes to the mounting housing at the plurality of openings by a fastener where the fastener offsets from the outer surface of the helmet shell. In some examples, the rail insert includes a channel recess on a side of the rail insert facing the outer surface of the helmet shell where the channel recess receives a tab configured to change a position of the rail insert between the plurality of openings. In some implementations, the mounting system is fastened to the outer surface at a front portion of the helmet shell and rear portion of the helmet shell. The harness may attach to an internal slot disposed on the internal surface of the helmet shell. Here the internal slot is adhered to the internal surface of the helmet shell.

A fourth aspect of the disclosure provides a method of assembling a ballistic helmet. The method includes providing a helmet shell that includes an outer surface and an internal surface. The method further includes attaching a harness to the internal surface of the helmet shell at a first attachment location. The method also includes attaching a mounting surface to the outer surface of the helmet shell at a second location where the second location is different than the first location.

Implementations of this disclosure the method may include one or more of the following optional features. In some examples, the mounting system includes a mounting housing fixed to the outer surface of the helmet shell and a rail insert disposed on the mounting housing. In some implementations, the rail insert corresponds to a Picatinny rail. In some configurations, the mounting housing is an arcuate shape located at an edge of the helmet shell. The mounting housing may include a plurality of openings configured to receive the rail insert. In some examples, the rail insert affixes to the mounting housing at the plurality of openings by a fastener where the fastener offsets from the outer surface of the helmet shell. In some implementations, the rail insert includes a channel recess on a side of the rail insert facing the outer surface of the helmet shell where the channel recess receives a tab configured to change a position of the rail insert between the plurality of openings. The mounting system may be fastened to the outer surface at a front position of the helmet shell and a rear portion of the helmet shell. In some examples, the harness attaches to an internal slot disclosed on the internal slot disposed on the internal surface of the helmet shell. Here, the internal slot may be adhered to the internal surface of the helmet shell.

A fifth aspect of the disclosure provides a ballistic helmet that includes a helmet shell, a mounting system, and a harness. The helmet shell includes an outer surface and an internal surface. The mounting surface is attached to an outer surface by a first securement means. The harness is attached to an internal surface of the helmet shell by a second securement means where the second securement means is independent of the first securement means.

Implementations of this disclosure may include one or more of the following optional features. In some example, the first securement means includes a first fastener in a front portion of the helmet shell and a second fastener in a rear portion of the helmet shell and a second securement means that includes a third fastener in the front portion of the helmet shell and a fourth fastener in the rear portion of the helmet shell. In some implementations, the first securement means includes a first pair of fasteners through the helmet shell and a second securement means that includes a second pair of fasteners through the helmet shell. In some configurations, the first securement means includes an intermediate member having a fastener where the fastener is separate from an attachment location of the mounting system. The second securement means may include an intermediate member having a fastener where the fastener is separate from an attachment location of the harness.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
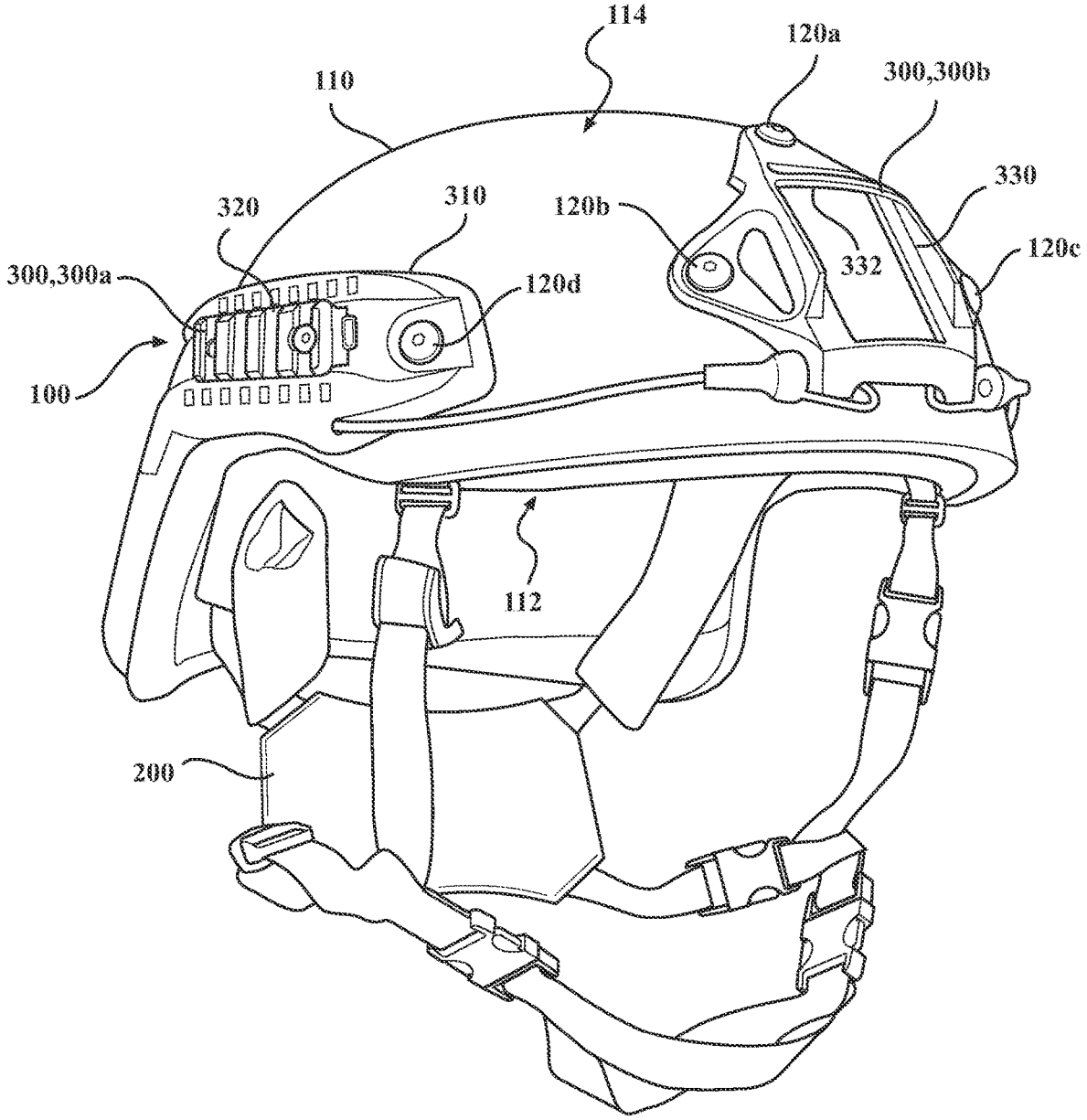
FIGS. 1A and 1B are perspective views of example ballistic helmets.
Figure 1B:
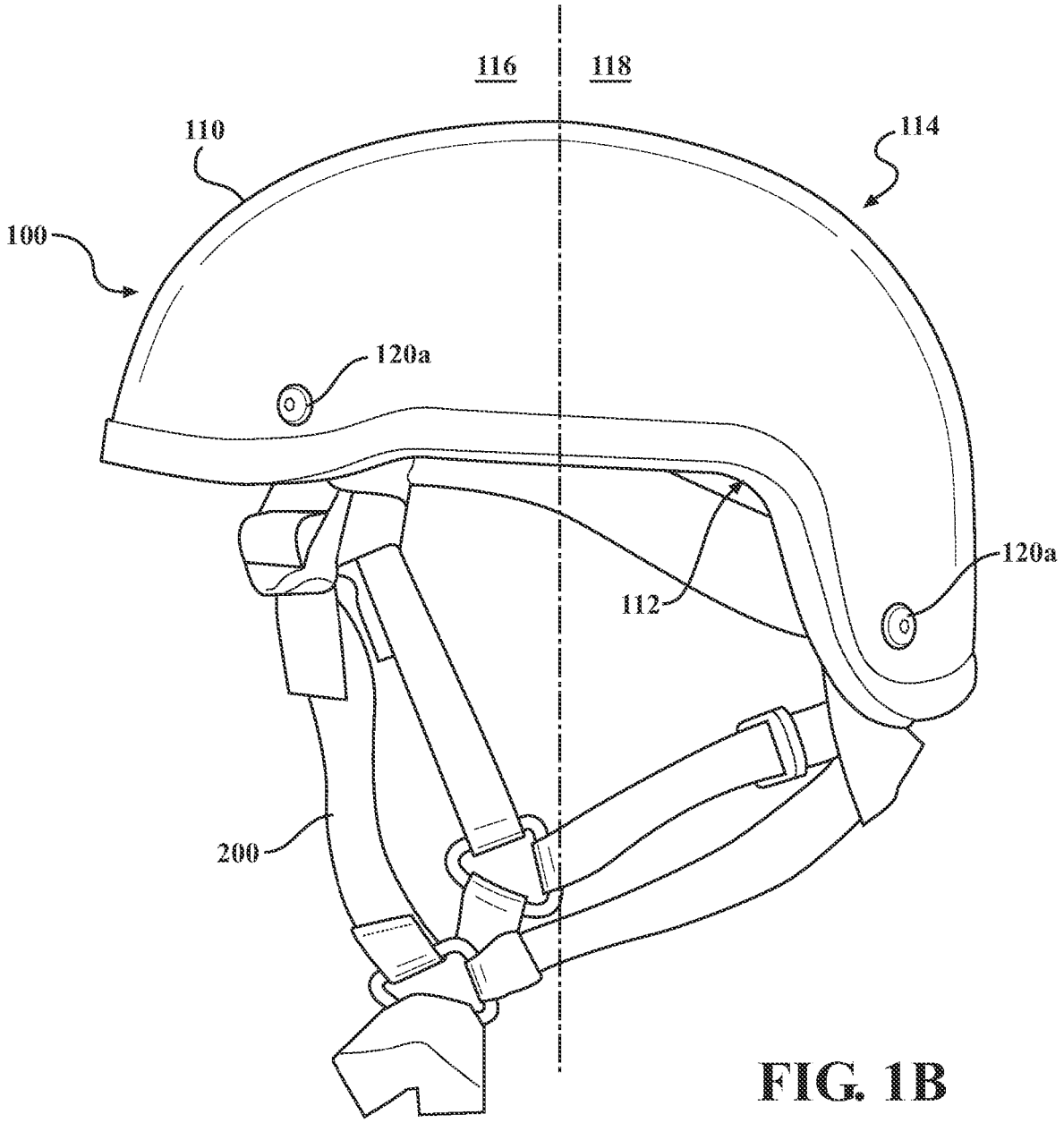

FIGS. 1A and 1B are examples of a ballistic helmet 100 (also referred to as the helmet 100). In FIG. 1A, the helmet 100 includes a helmet shell 110, a harness 200, and at least one mounting system 300. In some examples, such as FIG. 1B, the helmet 100 includes the helmet shell 110 and a harness 200 without any mounting system 300. In yet other examples, the helmet 100 includes the helmet shell 110 and any mounting system 300 without a harness 200. Here, the configuration of the helmet 100 with an accessory system (e.g., a harness 200 and/or a mounting system 300) depends on the needs of the wearer. For example, although any design may provide lightweight and robust protection, certain configurations of the helmet 100 without the at least one mounting system 300 are lighter than a configuration with the at least one mounting system 300. A wearer who prefers a more lightweight design during use (e.g., a wearer who is particularly mobile) may therefore prefer the helmet 100 illustrated in FIG. 1B. On the other hand, when the wearer may use more tactical equipment or special equipment (e.g., communication equipment, nighttime equipment, etc.) the wearer may be less concerned about weight and rather desire a greater level of functionality with the at least one mounting system 300.

As shown in FIGS. 1A and 1B, the harness 200 and/or each mounting system 300 is secured to the helmet 100. In some examples, the harness 200 and/or each mounting system 300 is removably secured to the helmet 100. The harness 200 may attach to an internal surface 112 of the helmet shell 110 while each mounting system 300 generally secures to an outer surface 114 of the helmet shell 110. In some implementations, the harness 200 and/or each mounting system 300 attaches to the helmet shell 110 by means of fasteners 120 (e.g., screws, bolts, rivets, etc.). In other examples, the harness 200 and/or each mounting system 300 is secured to the helmet shell 110 by methods that do not require drilling or forming a hole within the helmet shell 110 (e.g., FIG. 3). In other words, an aperture for a fastener 120 in a helmet shell 110 may, at the location of the aperture, reduce the local integrity of the helmet shell 110. If the helmet 100 receives a direct impact at this particular location, the helmet 100 may fail causing potential injury to the wearer. By securing the harness 200 and/or each mounting system 300 to the helmet shell 110 without drilling or forming a hole within or through the helmet shell 110, the helmet shell 110 may maintain its integrity. Some examples of these securement methods include adhering (e.g., by adhesive), molding, welding (e.g., sonic welding, heat staking, fusing), etc. In other configurations, the size and/or exposure of fasteners securing the harness 200 and/or the mounting system 300 may be optimized to reduce potential failure at locations of the fasteners 120.

The helmet shell 110 may be divided up into portions/regions to define locations of connections and/or securement for the helmet 10. The helmet shell 110 includes a front portion 116 (or front region) and a rear portion 118 (rear region). The front portion 116 generally corresponds to a portion of the helmet 100 that covers the frontal bone of the wearer (i.e. front half of the helmet 100 curving towards a face of a wearer). The rear portion 118 generally corresponds to a portion of the helmet 100 that covers the parietal bone of the wearer (i.e. rear half of the helmet curving towards a neck of the wearer) and, in some cases, extends to protect at least a portion of a neck of the wearer. As shown the side view of FIG. 1B, the front portion 116 of the helmet shell 110 extends to a forehead region of the wearer and terminates before covering the eyes of the wearer to obstruct any vision. FIGS. 1A and 1B also illustrate that sides of the helmet 100 curve around ears of the wearer and extend towards the neck of the wearer such that the rear portion 118 has greater surface area and extends lower on the wearer (e.g., towards a jawline) than the front portion 116.

FIG. 1A is an example of a helmet 100 with the harness 200 and two mounting systems 300, 300*a*-*b*, a first mounting system 300*a* and second mounting system 300*b*. Here, the first mounting system 300*a* is a rail mounting system 300*a*. The rail mounting system 300*a* includes rail housing 310 and a rail insert 320. The rail housing 310 generally arcs around the side of the helmet 100 where the front portion 116 transitions to the rear portion 118 around an ear of the wearer (i.e. such that the rail housing 310 extends towards the neck of the wearer). The rail housing 310 receives the rail insert 320 (e.g., a Picatinny rail insert) to mount accessories compatible with the rail insert 320. As shown in FIG. 1A, the rail mounting system 300*a* is secured to the helmet shell 110 at the rail housing 310 by one or more fasteners 120 (e.g., fastener 120*d*).

The second mounting system 300*b* is a shroud mounting system 300*b*. The shroud mounting system 300*b* is attached to the helmet shell 110 by fasteners 120 (e.g., shown in FIG. 1A as three fasteners 120*a*-*c*). The shroud mounting system 300*b* is configured to receive mounting accessories such as night vision goggles, cameras, etc. The shroud mounting system 300*b* includes a rectangular frame 330 with recesses 332 to receive at least one mounting accessory. In some configurations, such as FIG. 1A, the first mounting system 300*a* is connected to the second mounting system 300*b* (e.g., shown as an elastic cord with hooked ends).

Figure 2A:
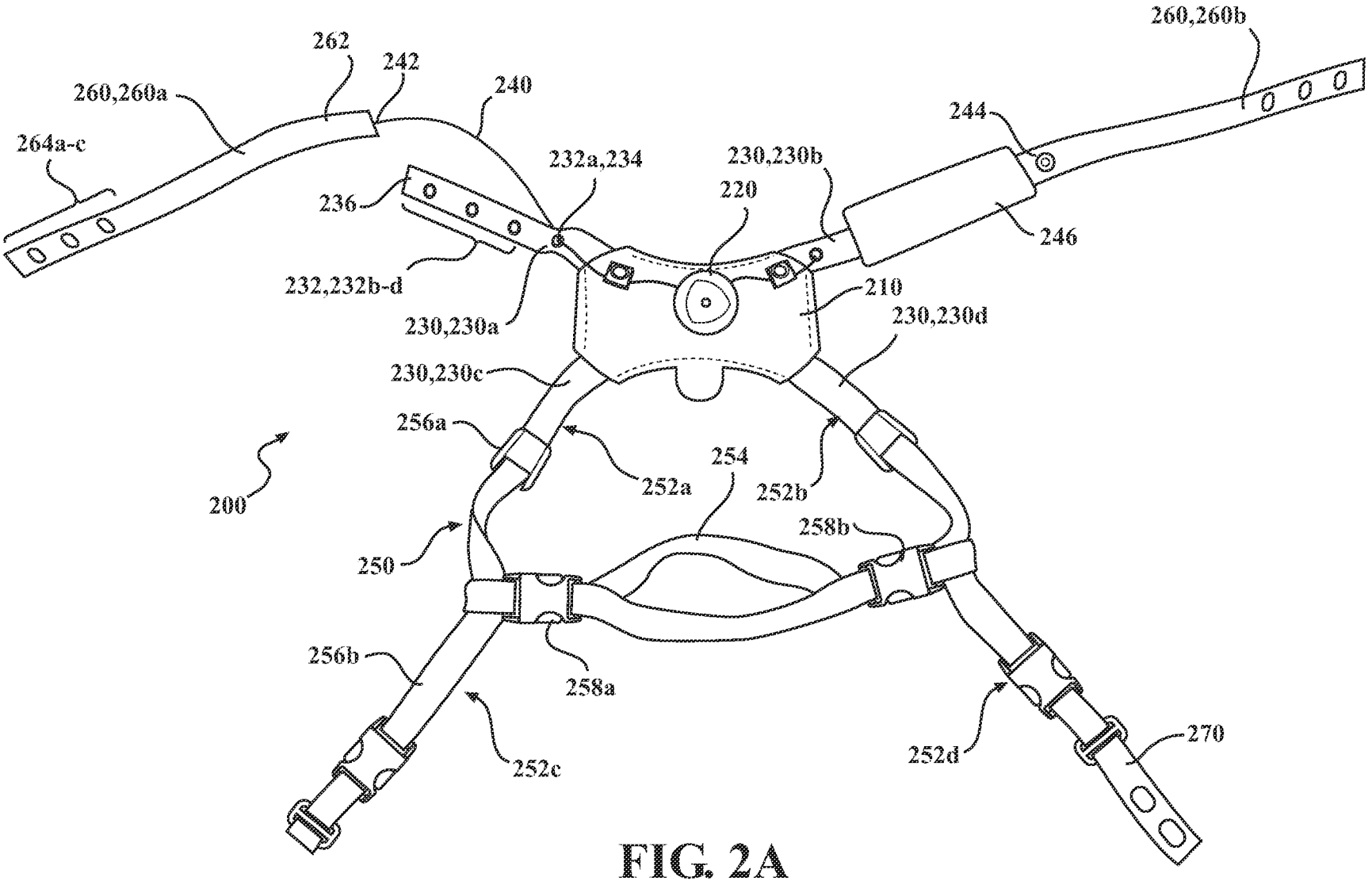
FIG. 2A is a perspective view of an example harness for a ballistic helmet.
Figure 2B:
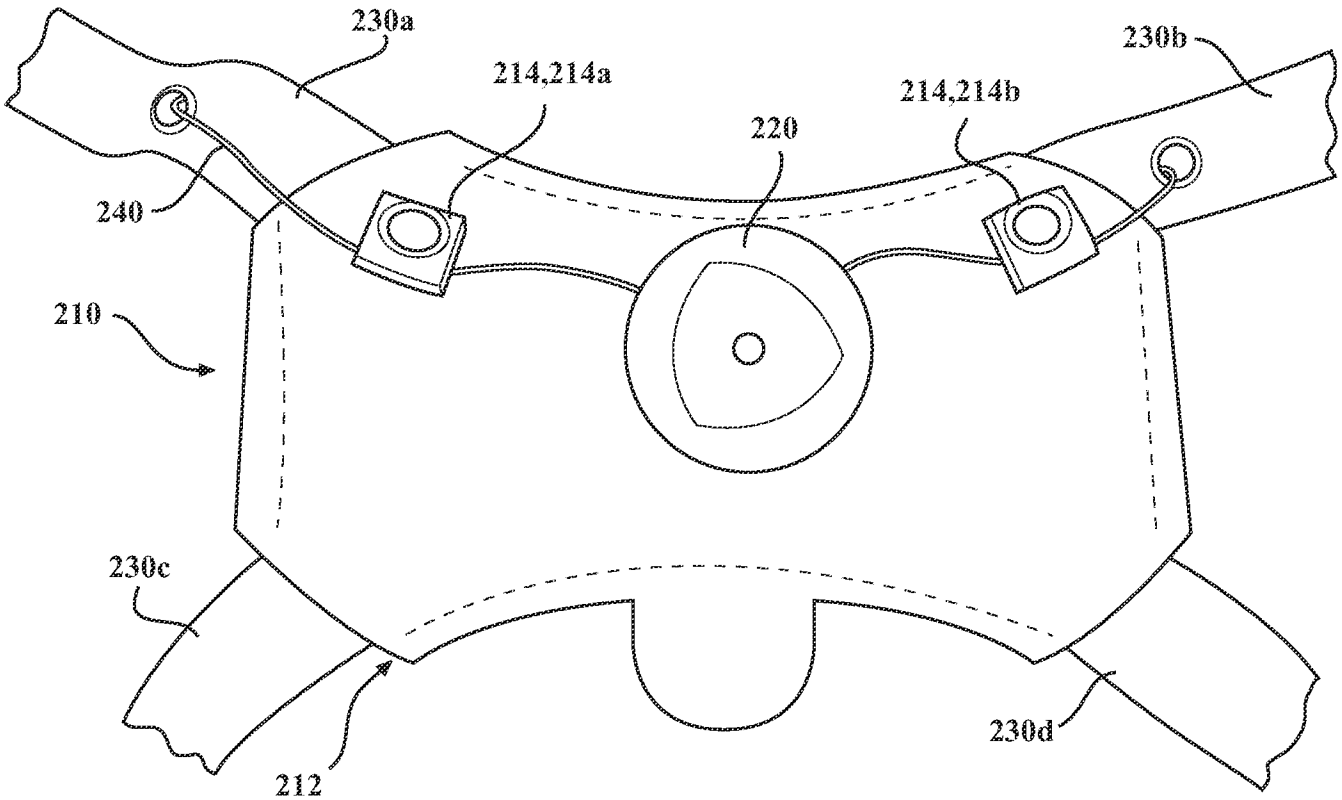
FIG. 2B is a close up view of a nape pad of a harness.
Figure 2C:
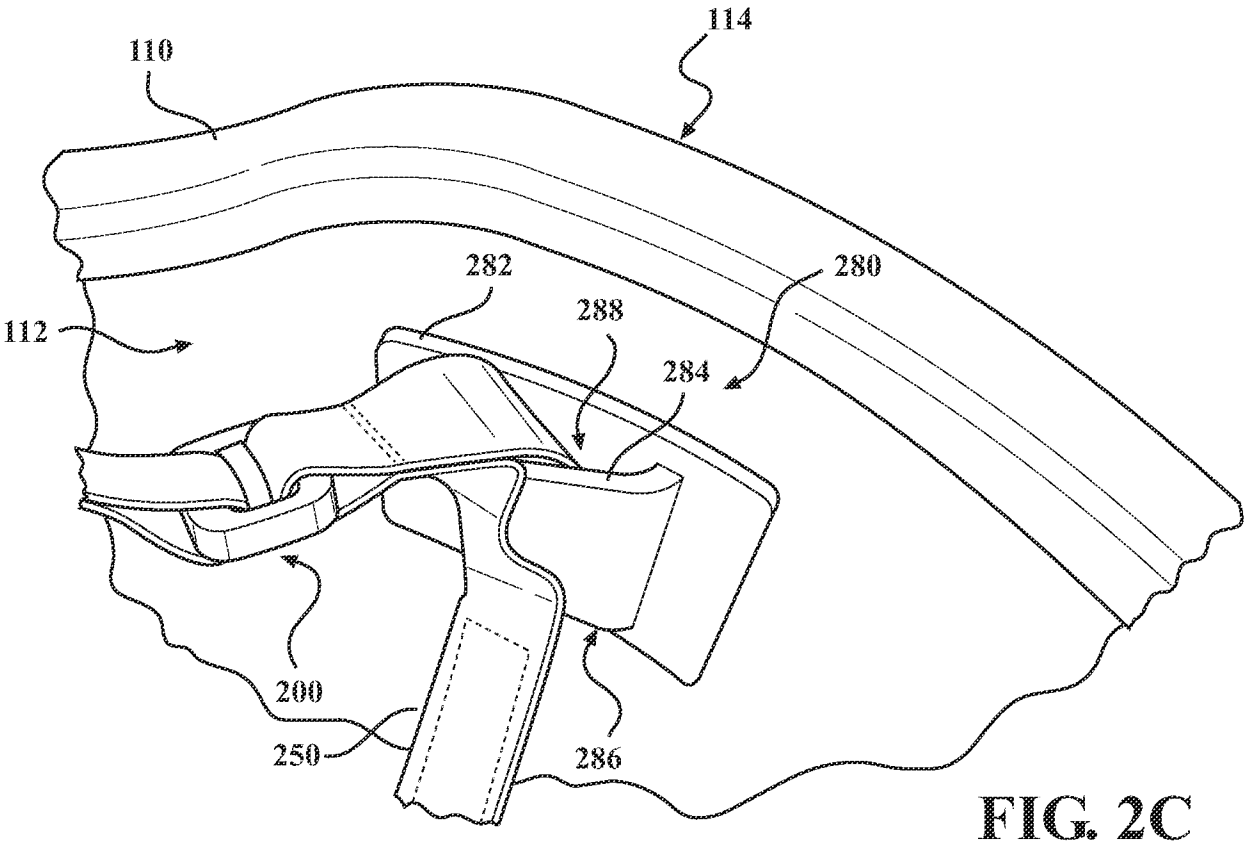
FIG. 2C is a perspective view of an example internal attachment environment for a harness.

FIGS. 2A-2C are examples of the harness 200 (or portions of the harness 200) for the ballistic helmet 100. Referring to FIG. 2A, the harness includes a nape pad 210, a tensioner 220, more than one securement strap 230, and a tension cable 240. The nape pad 210 is shown as a generally rectangular padded panel. The nape pad 210 supports (e.g., cradles) a nape of a neck of the wearer during use. The harness 200 is configured to be adjustable to fit the head of the wearer. As the tensioner 220 is selectively adjusted, the nape pad 210 may be drawn towards the helmet shell 110 to tighten a fit of the harness 200 for the wearer. Conversely, the tensioner 220 may be selectively adjusted such that the nape pad 210 increases in distance from the helmet shell 110 to loosen a fit of the harness 200 for the wearer. For example, the tensioner 220 may be adjusted to increase or decrease a tension of the tension cable 240. When the tensioner 220 increases the tension of the tension cable 240, the nape pad 210 decreases in distance from the helmet shell 110 and respectfully tightens against the back of the head of the wearer. When the tensioner 220 decreases the tension of the tension cable 240, the nape pad 210 increases in distance from the helmet shell 110 and respectfully loosens against the back of the head of the wearer.

With reference to FIG. 2B, in some examples, the nape pad 210 includes an internal cavity 212. The internal cavity 212 may receive the more than one securement strap 230. In some examples, the more than one securement strap 230 extends through the internal cavity 212 from one side of the internal cavity 212 of the nape pad 210 to an opposite side of the internal cavity 212 of the nape pad 210. By extending through the internal cavity 212, a securement strap 230 may be a continuous strap that extends from a fastener 120 at a rear portion 118 of the helmet shell 110 to a chin strap 250 that fastens to a front portion 116 of the helmet shell 110. In some examples, the internal cavity 212 includes padding. In other examples, a material forming the internal cavity 212 is a padded or comfortable material such that no padding is within the internal cavity 212. Additionally or alternatively, the more than one securement strap 230 may be fixed or sewn to the nape pad 210. This direct connection may be a configuration where the internal cavity 212 solely provides padding rather than receiving the more than one securement strap 230.

In some implementations, the nape pad 210 forms the internal cavity 212 by sewing together a front and a back portion of the nape pad 210 (e.g., sewn around a perimeter of the nape pad 210). The front and the back portion may be made of the same material or of different materials. When the front and back portions are sewn together, unsewn portions may generate openings for the internal cavity 212. The unsewn portions in FIG. 2B are shown in each corner of the nape pad 210 as locations where a securement strap 230 enters/exits the internal cavity 212.

In some examples, the nape pad 210 includes one or more guides 214. The one or more guide 214 may be located anywhere on the nape pad 210. The guide 214 may include a channel or a groove that guides the tension cable 240 from the tensioner 220 towards the front portion 116 of the helmet shell 110. The guide(s) 214 may depend from the tensioner 220 (e.g., attached to the tensioner 220) or be independent of the tensioner 220. The guide 214 may also be configured to prevent friction between a surface of the nape pad 210 and the tension cable 240 as the tensioner 220 adjusts the tension of the tension cable 240. For example, the guide 214 prevents any direct connection between the nape pad 210 (e.g., surface of the nape pad 210) and the tension cable 240 to prevent binding and increased friction that may damage the adjustable functionality of the harness 200. Referring to FIG. 2B, the guides 214, 214*a-b* are located on both sides of the tensioner 220.

The tensioner 220 is configured for the wearer to selectively adjust the fit of the helmet 100. Here, the wearer uses the tensioner 220 to adjust the tension within the tension cable 240 to move the nape pad 210 and/or harness 200 closer to securement points for the harness 200 on the helmet shell 110. In some examples, the tensioner 220 is configured to wind or to unwind the tension cable 240 around a fixed point (e.g., fixed point of the tensioner 220 fixed to the nape pad 210). In some implementations, the tensioner 220 is configured to ratchet the tension cable 240. The tensioner 220 may tighten the tension cable 240 such that each side (left side or right side) of the harness 200 is adjustable independently or collectively. For example, the tensioner 220 interacts with a single continuous tension cable 240 impacting the tension jointly on each side of the helmet 100 or two or more tension cables 240 impacting the tension independently on each side of the helmet 100. Although the tensioner 220 is shown as a ratchet-style tensioner 220, other examples of tensioners 220 include cord/cable locks (e.g., similar to drawstring locks), adjustable screws, etc.

The more than one securement strap 230 is configured to attach to one or more positions on the helmet shell 110. A securement strap 230 generally refers to a strap (e.g., webbing strap) that communicates (e.g., fixedly) with the nape pad 210. In some examples, the more than one securement strap 230 attaches to the rear portion 118 of the helmet shell 110. In other examples, the more than one securement strap 230 attaches to the rear portion 118 of the helmet shell 110 and to a chin strap 250 of the harness 200. In some configurations, the securement strap 230 engages with the nape pad 210 by entering (or exiting) the internal cavity 212 of the nape pad 210.

Each securement strap 230 may be configured with one or more aperture 232. For example, FIG. 2A depicts a first upper securement strap having four apertures 232. Each aperture 232 may include an eyelet 234 or grommet surrounding the aperture 232 for protection (e.g., from fraying or ripping). In some examples, the aperture 232 with the eyelet 234 receives the tension cable 240 such that friction caused by the tension cable 240 does not compromise the aperture 232 (e.g., cause to rip or fray) or the tension cable 240. With more than one aperture 232, the apertures 232 may be uniformly spaced or having varying spacing. For example, FIGS. 2A and 2B depicts a first aperture 232*a* adjacent to the nape pad 210 at a different spacing than three other apertures 232*b-d* along the securement strap 232*a-b* near an end 236 of the securement strap 230 that attaches to the rear portion 118 of the helmet shell 110. Here, the first aperture 232*a* with the eyelet 234 receives the tension cable 240. Although four apertures 232 and a single eyelet 234 are shown in FIG. 2A, different securement straps 230 may have a different number of apertures 232/eyelets 234 (e.g., one, two, three, four, five, etc.) or for ease of manufacturing share the same number of apertures 232/eyelets 234 (e.g., even though one or more may not be functional for a particular harness configuration). In some examples, when the eyelet 234 receives the tension cable 240, the eyelet 234 guides the tension cable 240 towards the front portion 116 of the helmet shell 110. By having an eyelet 234 receive the tension cable 240, the securement strap 230 with the eyelet 234 may reinforce the tension cable 240 for the harness 200.

In some examples, the securement strap 230 includes a tube or a channel extending along a length of the securement strap 230. Much like the eyelet 234, the protective tube or channel guides and/or protects the tension cable 240. The protection of the tube or channel also may function to reinforce the securement strap 230 while the tension cable 240, in conjunction with the tensioner 220, exerts a force on one or more securement straps 230. In other aspects, the tension cable 240 does not use any type of routing member or routing portion associated with a strap in order for the tension cable 240 to fasten from the tensioner 220 to the front portion 116 of the helmet shell 110. For example, the tension cable 240 is free of any guide system (i.e., does not traverse through any type of a tube, channel, or cylindrical guide). In some aspects, the tension cable 240 travels through a guide 214 on the nape pad 210, but no other strap or routing member associated with a strap when fastening to the front portion 116 of the helmet shell 110.

FIGS. 2A and 2B are examples of a configuration with four securement straps 230, 230*a-d*. For ease of explanation, the nape pad 210 has an upper region 216 and a lower region 218 (shown in FIG. 2B). In other words, the regions 216, 218 bisect the nape pad 210 into two halves. The upper region 216 refers to a half of the nape pad 210 that is closer to a top of the head of the wearer while the lower region 218 refers to a half of the nape pad 210 that is closer to the neck of the wearer. Accordingly, FIGS. 2A and 2B depict two securement straps 230*a*, 230*b* (a first upper strap 230*a* and a second upper strap 230*b*) in the upper region 216 (e.g., shown at each upper corner of the nape pad 210) and two securement straps 230*c*, 230*d* (a first lower strap 230*c* and a second lower strap 230*d*) in the lower region 218 (e.g., also shown at each lower corner of the nape pad 210). The first upper strap 230*a* connects to (e.g., bound by) the nape pad 210 and is configured to fasten to the rear portion 118 of the helmet shell 110. The second upper strap 230*b* also connects to (e.g., bound by) the nape pad 210 opposite the first upper strap 230*a* (e.g., shown at the opposite corner) and is configured to fasten to the rear portion 118 of the helmet shell 110 on a side of the rear portion 118 of the helmet shell 110 opposite the first upper strap 230*a*. The first lower strap 230*c* is connected to (e.g., bound by) the nape pad 210 and forms a first adjustable portion 252 of the chin strap 250. The second lower strap 230*d* connects to (e.g., bound by) the nape pad 210 opposite the first lower strap 230*c* and forms a second adjustable portion 252 of the chin strap 250.

In some examples, such as FIGS. 2A and 2B, the first upper strap 230*a* and the first lower strap 230*c* form a first continuous strap that extends through the internal cavity 212 of the nape pad 210. Here, the first continuous strap formed by the first upper strap 230*a* and the first lower strap 230*c* crosses through the internal cavity 212 (e.g., from the upper region 216 corner of the nape pad 210 to an opposite lower region 218 corner of the nape pad). Additionally or alternatively, the second upper strap 230*b* and the second lower strap 230*d* form a second continuous strap that extends through the internal cavity 212 of the nape pad 210. The second continuous strap formed by the second upper strap 230*b* and the second lower strap 230*d* crosses through the internal cavity 212 (e.g., from the upper region 216 corner of the nape pad 210 to an opposite lower region 218 corner of the nape pad).

In some configurations, a securement strap 230 that communicates with the nape pad 210 never attaches to the front portion 116 of the helmet shell 110. Rather, the tension cable 240 attaches to the front portion 116 of the helmet shell 110. In other words, the tension cable 240 is configured to fasten to the front portion 116 of the helmet shell 110 at a position on the helmet shell 110 adjacent to a temple of the wearer. This configuration may prevent irritation to the wearer. For example, if the tension cable 240 was routed along the more than one securement strap 230, the tensioner 220 may pull the tension cable 240 and may cause uncomfortable folds or bunching of a securement strap 230; irritating a wearer over time. With the tension cable 240 extending directly to the front portion 116 of the helmet shell 110, the tensioner 220 may directly control the fit of the helmet 100 without needing to affect other portions of the harness 200 directly or indirectly. To further provide comfort to the wearer during operation of the harness 200, a sleeve 246 may protect an outer surface of the tension cable 240. For example, FIG. 2A depicts the tension cable 240 at the right side of the harness 200 with the sleeve 246 while the tension cable 240 at the left side of the harness 200 is without the sleeve 246.

In some examples, the tension cable 240 includes a first end 242 and a second end 244. The first end 242 and the second end 244 are configured to fasten to opposite sides of the front portion 116 of the helmet shell 110. For example, the tension cable 240 is a unitary structure extending from a first side of the front portion 116 of the helmet shell 110 through the tensioner 220 to an opposite second side of the front portion 116 of the helmet shell 110. In some implementations, a cable securement strap 260 is connected to the first end 242 and/or the second end 244 of the tension cable 240. The cable securement strap 260 may include a connector 262 (e.g., stitched into the cable securement strap 260) for binding/securing to the tension cable 240. The connector 262 may be any attachment means for the tension cable 240 including, for example, a simple aperture with an eyelet, a ring, a channel, or some type of crimp-on connection. The cable securement strap 260 may allow a reinforced connection to the front portion 116 of the helmet shell 110. For example, instead of connecting to a fastener 120 or other securement means at the front portion 116 of the helmet shell 110 with solely the tension cable 240, the cable securement strap 260 may provide a larger attachment surface area as well as reinforced strength (e.g., when the cable securement strap 260 is woven and/or stitched at a fastening location). Here, much like the securement strap 230, the cable securement strap 260 may include one or more apertures 264 formed in the strap 260 as connection points for fastening to the front portion 116 of the helmet shell 110. In FIG. 2A, the cable securement strap 260 includes three apertures 264*a-c* corresponding to potential sizes of a helmet shell 110 and/or locations where the harness 200 may secure to the helmet shell 110.

In some configurations, the harness 200 includes a chin strap 250. The chin strap 250 may be formed in part by the one or more securement strap 230 (e.g., partly by the first lower strap 230*c* and the second lower strap 230*d*) in combination with at least one chin support strap 254. The at least one chin support strap 254 may be a single strap forming an oval to cup/cradle a chin of the wearer. For example, the single strap includes bar tack stitching to reinforce and to shape the single strap into an oval chin support strap 254.

As shown by FIG. 2A, the chin strap 250 includes four adjustable portions 252*a-d* and is configured to attach to each side of the front portion 116 of the helmet shell 110. The adjustable portions 252 may be a combination of straps and strap adjustors 256 (e.g., latching strap adjustors). For example, FIG. 2A illustrates that each side of the chin strap 250 includes two strap adjustors 256. In some configurations, each side of the chin strap 250 also includes a buckle 258 bisecting the two strap adjustors 256. In these configurations, the buckle 258 attaches to the at least one chin support strap 254 allowing a wearer to manually connect or disconnect the chin support strap 254. As shown in FIG. 2A, the chin support strap 254 attaches to two buckles 258 where each buckle 258*a-b* is associated with a respective side of the chin strap 250.

In some implementations, the chin strap 250 includes a chin strap attachment portion 270. The chin strap attachment portion 270 may connect to an adjustable portion 252 (e.g., at an adjustor 256). For example, FIG. 2A, depicts the chin strap attachment portion 270 attached by a ring and at least one strap. In these implementations, the chin strap attachment portion 270 is a portion of the chin strap 250 configured to be attached to the front portion 116 of the helmet shell 110 (e.g., via apertures formed in the chin strap attachment portion 270). In some examples, the chin strap 250 (e.g., by the chin strap attachment portion 270) is configured to be commonly affixed with the first upper strap 230*a* and the second upper strap 230*b* at each side of the front portion 116 of the helmet shell 110.

Additionally or alternatively, the one or more securement strap 230 (e.g., the first/second continuous strap formed by the upper and lower straps) is a continuous strap extending through the internal cavity 212 and woven through the adjustors 256 (i.e., forming at least part of the adjustable portion) to attach to the chin attachment portion 270. In some instances, if the chin strap 250 does not include a separate chin strap attachment portion 270, the same securement strap 230 may extend from a connection at the rear portion 118 of the helmet shell 110 through the nape pad 210 and the chin strap 250 to a connection at the front portion 116 of the helmet shell 110. This construction may reduce the number of straps and material required to make the harness 200, but in some instances, require more stitching and/or strap folding than other harness configurations.

Although not readily apparent from FIGS. 1A and 1B, the harness 200 and a mounting system 300 may be secured at different attachment locations and/or secured in different manners. For example, even though the harness 200 and the mounting system 300 attach in a similar region of the front portion 116 (e.g., adjacent to the temple of the wearer), each of the harness 200 and the mounting system 300 use different fasteners 120. In other examples, the mounting system 300 uses a fastener 120 extending through the helmet shell 110 while the harness 200 attaches only internally without the need for a fastener 120 (via an aperture) through the helmet shell 110 (or vice versa, e.g., the mounting system utilizes the internal attachment environment 280 disclosed below). In yet other examples, both the harness 200 and the mounting system 300 attach to the helmet shell 110 using the techniques of the attachment environment 280. Thus, in this embodiment, the mounting system 300 fastener 120 is not the same mounting fastener (or fastening means) as that used to attach the harness 200 to the helmet shell 110.

FIG. 2C depicts an example of an internal attachment environment 280 where the harness 200 attaches to the helmet shell 110 only at an internal surface 112 of the helmet shell 110. Here, the internal attachment environment 280 includes an attachment pad 282 secured to the internal surface 112 of the helmet shell 110. Molding may include integrally formed from the same material as the helmet shell during the fabrication of the helmet shell. Molding may also include integrally forming the attachment pad with the helmet shell during formation of the helmet shell wherein the pad is formed from material which is dissimilar to the material used in the fabrication of the helmet shell. The attachment pad 282 may be adhered, welded, molded, etc. to the internal surface 112. In some examples, a size of the attachment pad 282 corresponds to a strength of adhesion between the internal surface 112 and the attachment pad 282 to support the harness 200.

As shown in FIG. 2C, the internal attachment environment 280 may also include a slot 284 (or channel) disposed on the attachment pad 410. For example, the slot 284 (or channel) is formed into the attachment pad 282 such as by molding. The slot 284 includes a first opening 286 and a second opening 288 for receiving a strap of the harness 200. At least one strap of the harness 200 enters the first opening 286 and exits the second opening 288. In some implementations, a portion of the chin strap 250 (e.g., the chin strap attachment portion 270) is received by the slot 284. In some examples, the slot 284 allows the harness 200 to form a loop that attaches the harness 200 to the helmet shell 110. This loop may allow the harness 200 to secure upon itself or fasten to another portion of the helmet shell 110.

Additionally or alternatively, the harness 200 may directly attach to the internal surface 112 of the helmet shell 110. For example, a similar adhesive, welding (e.g., heat staking or sonic welding), or molding process used by the internal attachment environment 280 simply connects the harness 200 to the internal surface 112 of the helmet shell 110. In other examples, the harness 200 attaches to the internal surface 112 of the helmet shell 110 by way of the slot 284 without the intermediary of the attachment pad 282 (i.e., the slot 284 also functions as the attachment pad).

Figure 3:
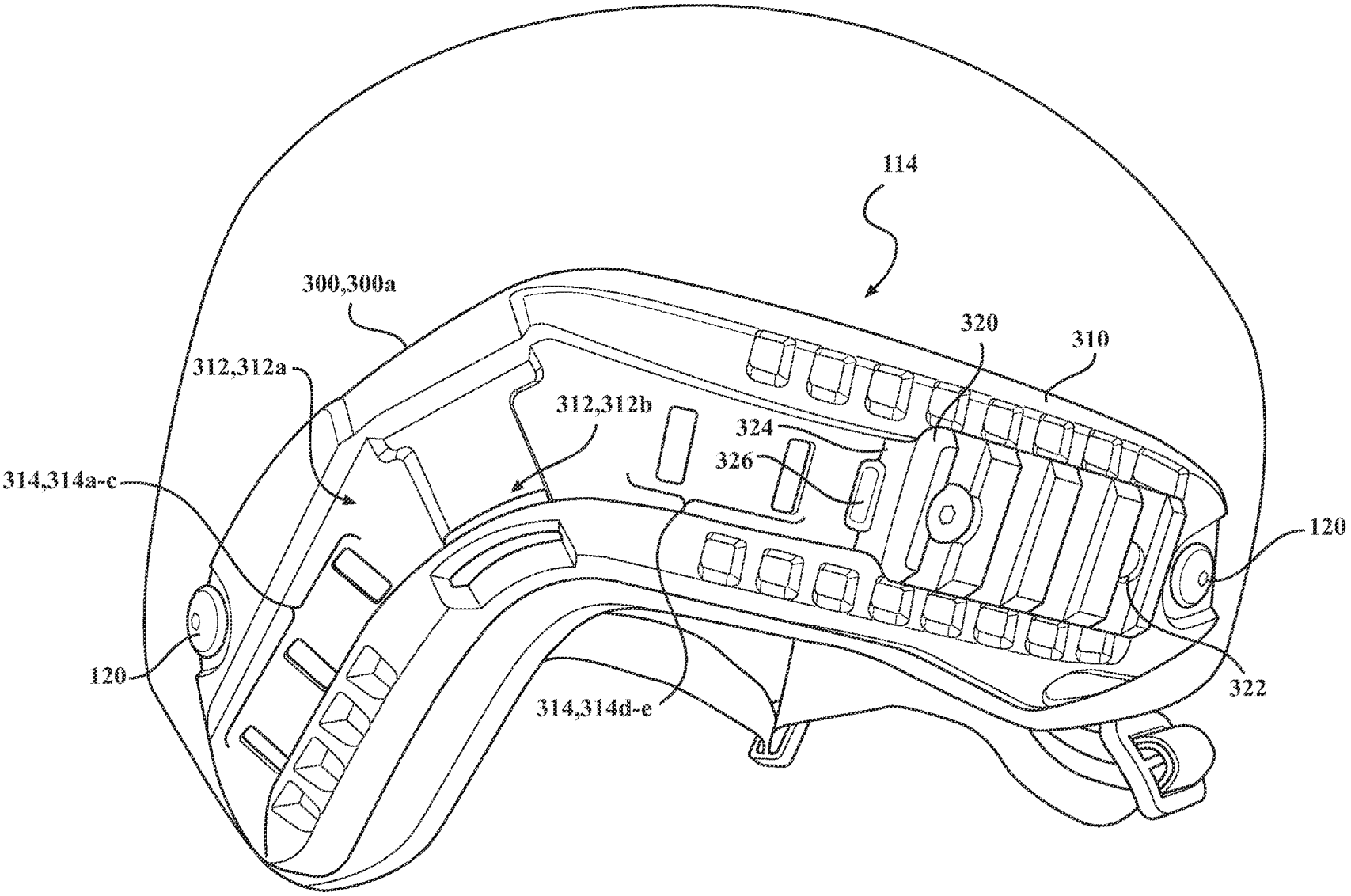
FIG. 3 is a perspective view of an example mounting system for a ballistic helmet.

FIG. 3 is a close-up view of the rail mounting system 300*a*. The rail mounting system 300*a* includes the rail housing 310 and the rail insert 320. In some examples, the rail housing 310 includes a first recess 312, 312*a* (or channel) shaped like an arcuate letter "L." For discussion, the first recess 312 has a first segment predominantly in the rear portion 118 of the helmet shell that extends towards the wearer's neck and a second segment parallel to a ground surface during use of the helmet 100 that extends from the front portion 116 to the rear portion 118. The first recess 312*a* includes a plurality of openings 314, 314*a-n* where n corresponds to the number of openings. In the example shown by FIG. 3, the first recess 312*a* includes three openings 314, 314*a-c* formed along the first segment and two exposed openings 314*d-e* along the second segment. In some implementations, the openings 314 are elongated in shape (e.g., rectangular) extending generally across the first recess 312*a*. For example, the openings 314 are slots. In FIG. 3, the rail insert 320 fastens (via fasteners 322) to one or more openings 314 in the first recess 312*a*. Here, the rail housing 310 offsets the openings 314 from the outer surface 114 such that fasteners 120 used to secure the rail insert 320 do not come in contact with the outer surface 114 of the helmet shell 110. In some implementations, the rail insert 320 includes a recessed channel 324 at a side of the rail insert 320 facing the outer surface 114 of the helmet shell 110. The recessed channel 324 receives a tab 326 (e.g., a flexible tab) that enables the rail insert 320 to slide in the first recess 312*a* between openings 314 when the fastener 322 is loosened. Additionally or alternatively, the rail housing 310 includes a second recess 312*b* (e.g., shown shaped like a "T"). In some examples, the second recess 312*b* is further recessed towards the outer surface 114 of the helmet shell 110 from a surface of the first recess 312*a*.

Figure 4:
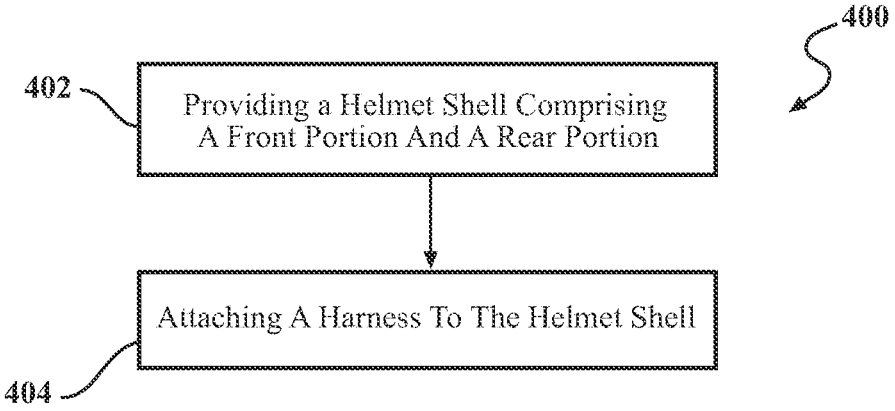
FIG. 4 is a flow diagram of an example method of assembling a ballistic helmet.

FIG. 4 is an example of a method 400 of assembling a ballistic helmet 100. At operation 402, the method 400 includes providing a helmet shell 110 that includes a front portion 116 and a rear portion 118. At operation 404, the method 400 includes attaching a harness 200 to the helmet shell 110. In some examples, the operation 404 of method 400 includes fastening a first end 242 and a second end 244 of the tension cable 240 to opposite sides of the front portion 116 of the helmet 100 at a position on the helmet 100 adjacent a temple of the wearer. The tension cable 240 may be a unitary structure extending from a front portion 116 of the helmet 100 to an opposite second side of the front portion 116 of the helmet 100. In some implementations, attaching the harness 200 to the helmet shell 110 at operation 404 includes connecting a cable securement strap 260 to a first end 242 of the tension cable 240 and to the front portion 116 of the helmet 100. In some configurations, attaching the harness 200 to the helmet shell 110 at operation 404 includes fastening an end 242, 244 of the tension cable 240 to the front portion 116 of the helmet 100 through an eyelet 234 of the more than one securement strap 230. The more than one securement strap 230 may be directly fixed to the nape pad 210 and the tension cable 240 is free of direct connections to the nape pad 210.

In some examples, attaching the harness 200 to the helmet shell 110 at operation 404 includes the following: fastening a first upper strap 230*a* of the more than one securement strap 230 to the rear portion 118 of the helmet 100 where the first upper strap 230*a* of the more than one securement strap 230 is connected to the nape pad 210; and fastening a second upper strap 230*b* of the more than one securement strap 230 to the rear portion 118 of the helmet 100 opposite the first upper strap 230*a* where the second upper strap 230*b* of the more than one securement strap 230 is connected to the nape pad 210 opposite the first upper strap 230*a*. In these examples, attaching the harness 200 to the helmet shell 110 at operation 404 may further include fastening a chin strap 250 to each side of the helmet shell 110 at a front portion 116 of the helmet shell 110 where the more than one securement strap 230 connected to the nap pad 210 includes a first lower strap 230*c* and a second lower strap 230*d* opposite the first lower strap 230*c*. Here, each of the first lower strap 230*c* and the second lower strap 230*d* is connected to an adjustable portion 252 of the chin strap 250. In these examples, fastening the chin strap 250 to each side of the helmet shell 110 at the front portion 116 of the helmet shell 110 may include commonly affixing at least a first portion 252 of the chin strap 250 with the first upper strap 230*a*.

Figure 5:
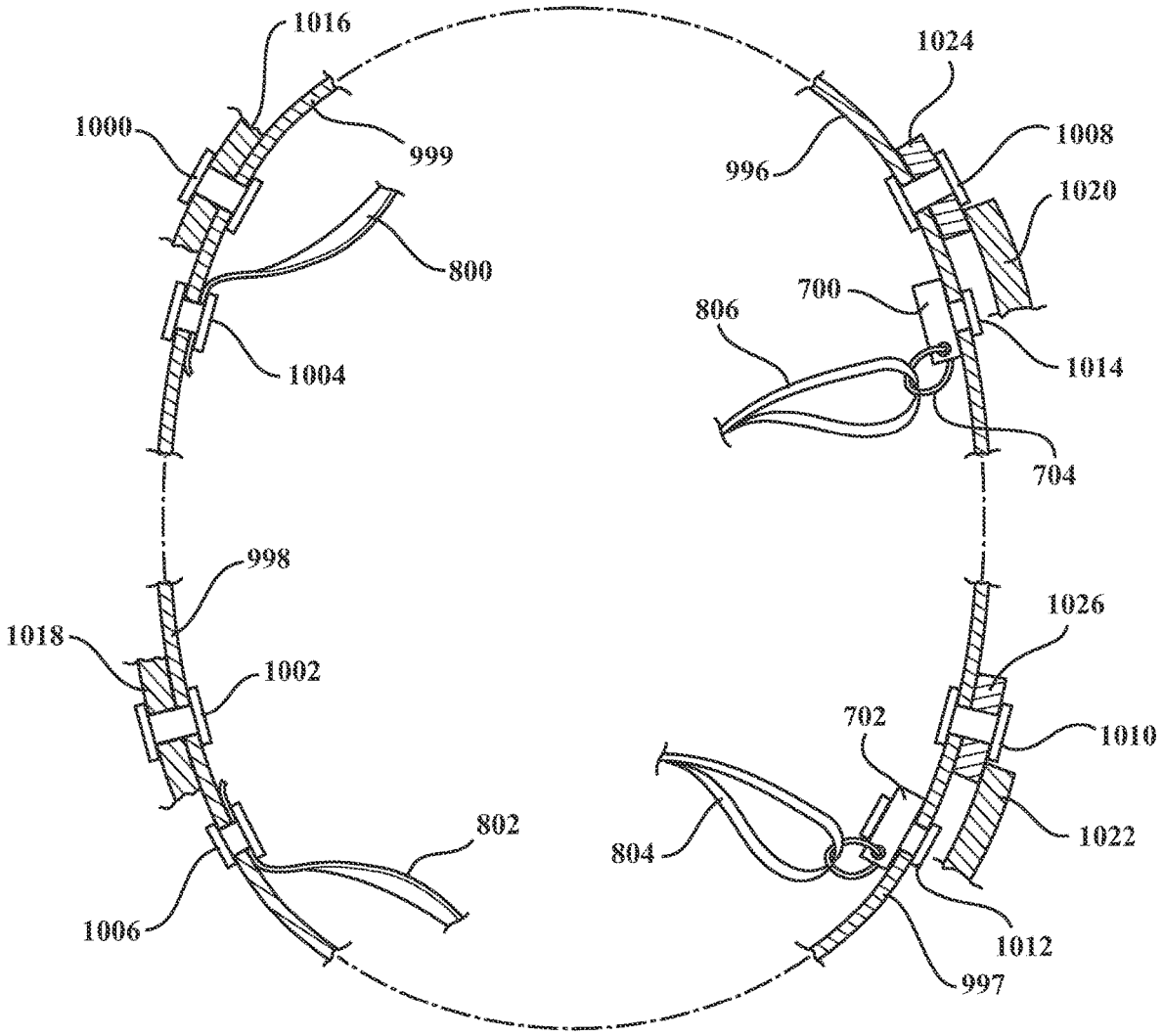
FIG. 5 is a schematic view of an example mounting system for a ballistic helmet.

FIG. 5 generally depicts a schematic view of an embodiment of helmet 100 looking towards the internal surface 112 to illustrate fasteners 1000-1014. Here, for simplicity, the helmet 100 is divided into four quadrants: a first quadrant 510 referring to a top left portion 999 of the helmet shell 110; a second quadrant 520 referring to a lower left portion 998 of the helmet shell 110; a third quadrant 530 referring to a top right portion 996 of the helmet shell 110; and a fourth quadrant 540 referring to a lower right portion 997 of the helmet shell 110. The first and second quadrant 510, 520 illustrate one example fastening configuration for the harness 200 and the mounting system 300 to attach to the helmet shell 110. The third and fourth quadrant 530, 540 illustrate another example fastening configuration for the harness 200 and the mounting system 300 to attach to the helmet shell 110.

In the first quadrant 510, a first fastener 1000 secures a first portion 1016 of a mounting system 300 (e.g., a portion of the rail housing 310) to the portion 999 of the helmet shell 110. For example, the fastener 1000 extends from the outer surface 114 to the internal surface 112 through the portion 999 of the helmet shell 110. A second fastener 1004, at a different location that is separate from the first fastener 1000, attaches a first portion 800 of the harness 200 to the portion 999 of the helmet shell 110 (e.g., at the internal surface 112 of the helmet shell 110). Portions 800, 802, 804, 806 of the harness 200 may correspond to at least one securement strap 230 or a cable securement strap 260. In some examples, the first portion 1016 of the mounting system 300 represents that a fastener, such as the first fastener 1000 attaches the mounting system 300 directly to the helmet shell 110 rather than attaching the mounting system 300 indirectly through an intermediary to the helmet shell 110.

As shown in FIG. 5, the second quadrant 520 is generally a mirror image of the first quadrant 510. Although a mirror image, the second quadrant 520 may correspond to the front portion 116 of the helmet shell 110 while the first quadrant 510 may correspond to the rear portion 118 of the helmet shell 110 (or vice versa). In the second quadrant 520, a third fastener 1002 secures a second portion 1018 of a mounting system 300 (e.g., a portion of the rail housing 310 or rail insert 320) to the portion 998 of the helmet shell 110. For example, the fastener 1002 extends from the outer surface 114 to the internal surface 112 through the portion 998 of the helmet shell 110. A fourth fastener 1006, at a different location that is separate from the third fastener 1002, attaches a second portion 802 of the harness 200 to the portion 998 of the helmet shell 110 (e.g., at the internal surface 112 of the helmet shell 110).

Referring further to FIG. 5, the third quadrant 530 and the fourth quadrant 540 illustrate that the harness 200 and the mounting system 300 may be fastened to the helmet shell 110 via intermediary members 1024, 1026, 700, 702. These intermediary members 1024, 1026, 700, 702 may be associated with the harness 200 and/or the mounting system 300 or portions that are separate components from the harness 200 and/or the mounting system 300. In some examples, the intermediary members 1024, 1026, 700, 702 correspond to members that receive a fastener to attach to the helmet shell 110 and that also connect or communicate with a portion of the harness 200 and/or the mounting system 300 (e.g., at an attachment location separate from a location where the intermediary member receives the fastener).

In the third quadrant 530, a fifth fastener 1008 secures a third portion 1024 to the portion 996 of the helmet shell 110. In some examples, the fifth fastener 1008 extends through the portion 996 of the helmet shell 110 (e.g., from the outer surface 114 to the internal surface 112). The third portion 1024 may be part of the mounting system 300 (e.g., the rail housing 310) or disposed on the helmet shell 110 to provide a securement means for the mounting system 300. For example, the third portion 1024 is a fixture shaped and configured to receive the mounting system 300. In some examples, such as FIG. 5, the third portion 1024 is connected to or adjacent to a fourth portion 1020. In some implementations, both the third portion 1024 and the fourth portion 1020 are portions of the mounting system 300. For instance, the third portion 1024 corresponds to the rail housing 310 while the fourth portion 1020 corresponds to the rail insert 320. Regardless of the configuration, as FIG. 5 depicts, the fourth portion 1020 represents that the mounting system 300 or a portion of the mounting system 300 does not need its own fastener and may rely on an adjacent fastener, such as the fifth fastener 1008 to provide securement to the portion 996 of the helmet shell 110.

With continued reference to the third quadrant 530, a sixth fastener 1014, at a different location separate from the fifth fastener 1008, provides a securement means to attach a third portion 806 of the harness 200 to the helmet shell 110. Here, the sixth fastener 1014 secures a first block member 700 to the internal surface 112 of the portion 996 of the helmet shell 110. Separate from the sixth fastener 1014, the block member 700 includes a first intermediate attachment element 704 (e.g., a strap, a cable, a wire, a lace, etc.) that attaches the third portion 806 of the harness 200 to the helmet shell 110. Compared to the first and second quadrant 510, 520, the sixth fastener 1014 does not directly attach to a portion of the harness 200 (e.g., the portion 806).

The fourth quadrant 540 is a mirror image of the third quadrant 530. Although a mirror image, the fourth quadrant 540 may correspond to the front portion 116 of the helmet shell 110 while the third quadrant 530 may correspond to the rear portion 118 of the helmet shell 110 (or vice versa). In the fourth quadrant 540, a seventh fastener 1010 secures a fifth portion 1026 to the portion 997 of the helmet shell 110. In some examples, the seventh fastener 1010 extends through the portion 997 of the helmet shell 110 (e.g., from the outer surface 114 to the internal surface 112). The fifth portion 1026 may be part of the mounting system 300 (e.g., the rail housing 310) or disposed on the helmet shell 110 to provide a securement means for the mounting system 300. For example, the fifth portion 1026 (e.g., similar to the third portion 1024) is a fixture shaped and configured to receive the mounting system 300. In some examples, such as FIG. 5, the fifth portion 1026 is connected to or adjacent to a sixth portion 1022. In some implementations, both the fifth portion 1026 and the sixth portion 1022 are portions of the mounting system 300. For instance, the fifth portion 1026 corresponds to the rail housing 310 while the sixth portion 1022 corresponds to the rail insert 320. Regardless of the configuration, as FIG. 5 depicts, the sixth portion 1022 represents that the mounting system 300 or a portion of the mounting system 300 does not need its own fastener and may rely on an adjacent fastener, such as the seventh fastener 1010 to provide securement to the portion 997 of the helmet shell 110.

With continued reference to the fourth quadrant 540, an eighth fastener 1012, at a different location separate from the seventh fastener 1010, provides a securement means to attach a fourth portion 804 of the harness 200 to the helmet shell 110. Here, the eighth fastener 1012 secures a second block member 702 to the internal surface 112 of the portion 997 of the helmet shell 110. Separate from the seventh fastener 1010, the second block member 702 includes a second intermediate attachment member 706 (e.g., a strap, a cable, a wire, a lace, etc.) that attaches the fourth portion 804 of the harness 200 to the helmet shell 110. Compared to the first and second quadrant 510, 520, the eighth fastener 1012 does not directly attach to a portion of the harness 200 (e.g., the portion 804).

Overall, FIG. 5 provides an illustration of how fasteners may be used to construct the helmet 100. Four fasteners 1000, 1002, 1008, 1010 may directly or indirectly attach the mounting system 300 to the helmet shell 110. Four other fasteners 1004, 1006, 1012, 1014 that are separate and distinct from fasteners 1000, 1002, 1008, 1010 may directly or indirectly attach the harness 200 to the helmet shell 110.

A number of implementations have been described. Nevertheless, it will be understood that various modifications may be made without departing from the spirit and scope of the disclosure. Accordingly, other implementations are within the scope of the following claims.

What is claimed is:

1. A ballistic helmet comprising:

a helmet shell comprising a front portion and a rear portion; and a harness connected to the helmet shell, the harness comprising:

nape pad;

a tensioner disposed on the nape pad;

more than one securement strap, the more than one securement strap connected to the nape pad and configured to fasten to the rear portion of the helmet shell, wherein the more than one securement strap comprises:

a first upper strap connected to the nape pad and configured to fasten to the rear portion of the helmet shell;

a second upper strap connected to the nape pad opposite to the first upper strap and configured to fasten to the rear portion of the helmet shell on a side of the rear portion of the helmet shell opposite the first upper strap;

a first lower strap connected to the nape pad and forming a first adjustable portion of a chin strap, and a second lower strap connected to the nape pad opposite the first lower strap and forming a second adjustable portion of the chin strap; and a tension cable selectively adjustable by the tensioner and configured to fasten to the front portion of the helmet shell, wherein the first upper strap and the first lower strap comprise a continuous strap extending through an internal cavity of the nape pad, and the second upper strap and the second lower strap comprise a second continuous strap extending through the internal cavity of the nape pad.

2. The ballistic helmet of claim 1, wherein the tension cable comprises a first end and a second end, the first end and second end configured to fasten to opposite sides of the front portion of the helmet shell at a position on the helmet shell adjacent to a temple of a helmet wearer.

3. The ballistic helmet of claim 2, further comprising a cable securement strap connected to the first end and configured to fasten to the front portion of the helmet shell, the cable securement strap comprising an aperture configured to receive a fastener to fasten to the front portion of the helmet shell.

4. The ballistic helmet of claim 1, wherein the more than one securement strap comprises an eyelet for receiving the tension cable, the eyelet receiving the tension cable when the tension cable is fastened to the front portion of the helmet shell.

5. The ballistic helmet of claim 1, wherein the more than one securement strap is directly fixed to the nape pad and the tension cable is free of direct connections to the nape pad.

6. The ballistic helmet of claim 1, wherein the chin strap is configured to be commonly affixed with the first upper strap and the second upper strap at each side of the front portion of the helmet shell.

7. A harness for a ballistic helmet, the harness comprising:

nape pad;

a tensioner disposed on the nape pad;

more than one securement strap, the more than one securement strap connected to the nape pad and configured to fasten to a rear portion of the helmet, wherein the more than one securement strap comprises:

a first upper strap connected to the nape pad and configured to fasten to the rear portion of the helmet;

a second upper strap connected to the nape pad opposite to the first upper strap and configured to fasten to the rear portion of the helmet on a side of the rear portion of the helmet opposite the first upper strap;

a first lower strap connected to the nape pad and forming a first adjustable portion of a chin strap, and a second lower strap connected to the nape pad opposite the first lower strap and forming a second adjustable portion of the chin strap; and a tension cable selectively adjustable by the tensioner and configured to fasten to a front portion of the helmet, wherein, the first upper strap and the first lower strap comprise a continuous strap extending through an internal cavity of the nape pad, and the second upper strap and the second lower strap comprise a second continuous strap extending through the internal cavity of the nape pad.

8. The harness of claim 7, wherein the tension cable is a unitary structure extending from a first side of the front portion of the helmet to an opposite second side of the front portion of the helmet.

9. The harness of claim 7, further comprising a cable securement strap connected to a first end of the tension cable and configured to fasten to the front portion of the helmet, the cable securement strap comprising an aperture configured to receive a fastener to fasten to the front portion of the helmet.

10. The harness of claim 7, wherein the more than one securement strap comprises an eyelet for receiving the tension cable, the eyelet receiving the tension cable when the tension cable is fastened to the front portion of the helmet.

11. The harness of claim 7, wherein the more than one securement strap is directly fixed to the nape pad and the tension cable is free of direct connections to the nape pad.

12. The harness of claim 7, wherein the chin strap is configured to be commonly affixed with the first upper strap and the second upper strap at each side of the front portion of the helmet.

13. A method of assembling a ballistic helmet, the method comprising:

providing a helmet shell comprising a front portion and a rear portion; and attaching a harness to the helmet shell, the harness comprising:

nape pad;

a tensioner disposed on the nape pad;

more than one securement strap, the more than one securement strap connected to the nape pad and configured to fasten to a rear portion of the helmet, wherein the more than one securement strap comprises:

a first upper strap connected to the nape pad and configured to fasten to the rear portion of the helmet;

a second upper strap connected to the nape pad opposite to the first upper strap and configured to fasten to the rear portion of the helmet on a side of the rear portion of the helmet opposite the first upper strap;

a first lower strap connected to the nape pad and forming a first adjustable portion of a chin strap, and a second lower strap connected to the nape pad opposite the first lower strap and forming a second adjustable portion of the chin strap; and a tension cable selectively adjustable by the tensioner and configured to fasten to a front portion of the helmet, wherein, the first upper strap and the first lower strap comprise a continuous strap extending through an internal cavity of the nape pad, and the second upper strap and the second lower strap comprise a second continuous strap extending through the internal cavity of the nape pad.

14. The method of claim 13, wherein the tension cable is a unitary structure extending from a first side of the front portion of the helmet to an opposite second side of the front portion of the helmet.

15. The method of claim 13, wherein attaching the harness to the helmet shell comprises connecting a cable securement strap to a first end of the tension cable and to the front portion of the helmet.

16. The method of claim 13, wherein attaching the harness to the helmet shell comprises fastening an end of the tension cable to the front portion of the helmet through an eyelet of the more than one securement strap.

17. The method of claim 13, wherein the more than one securement strap is directly fixed to the nape pad and the tension cable is free of direct connections to the nape pad.

18. The method of claim 13, wherein attaching the harness to the helmet shell comprises:

fastening a first upper strap of the more than one securement strap to the rear portion of the helmet, the first upper strap of the more than one securement strap connected to the nape pad; and fastening a second upper strap of the more than one securement strap to the rear portion of the helmet opposite the first upper strap, the second upper strap of the more than one securement strap connected to the nape pad opposite the first upper strap.

19. The method of claim 18, wherein attaching the harness to the helmet shell further comprises fastening a chin strap to each side of the helmet shell at a front portion of the helmet shell, the more than one securement strap connected to the nape pad comprising a first lower strap and a second lower strap opposite the first lower strap, each of the first lower strap and the second lower strap connected to an adjustable portion of the chin strap.

20. The method of claim 19, wherein fastening the chin strap to each side of the helmet shell at the front portion of the helmet shell comprises commonly affixing at least a first portion of the chin strap with the first upper strap.

* * * * *